US007644827B2

(12) United States Patent
Hanretty

(10) Patent No.: US 7,644,827 B2
(45) Date of Patent: Jan. 12, 2010

(54) BEVERAGE CONTAINER SHELF MANAGEMENT SYSTEM

(75) Inventor: Peter J. Hanretty, Port Chester, NY (US)

(73) Assignee: Source I Displays, a division of Fortune Resources, Inc., Bergenfield, NY (US)

( * ) Notice: Subject to any disclaimer, the term of this patent is extended or adjusted under 35 U.S.C. 154(b) by 235 days.

(21) Appl. No.: 11/288,637

(22) Filed: Nov. 29, 2005

(65) Prior Publication Data

US 2007/0119798 A1 May 31, 2007

(51) Int. Cl.
*A47F 1/04* (2006.01)

(52) U.S. Cl. ..... 211/59.2

(58) Field of Classification Search ..... 211/59.2, 211/59.3, 43, 184, 74, 175, 189, 105.1, 182; 312/35, 61, 71, 72, 42, 45
See application file for complete search history.

(56) References Cited

U.S. PATENT DOCUMENTS

| | | | | | |
|---|---|---|---|---|---|
| 4,183,438 | A * | 1/1980 | Huczek | 211/59.2 |
| 4,474,297 | A * | 10/1984 | Zucker | 211/59.2 |
| 4,785,945 | A | 11/1988 | Rowse et al. | 211/59.2 |
| 5,022,535 | A * | 6/1991 | Spamer | 211/59.2 |
| 5,190,171 | A * | 3/1993 | Christman, Jr. | 211/188 |
| 5,199,584 | A * | 4/1993 | Fowler et al. | 211/184 |
| 5,645,176 | A | 7/1997 | Jay | 211/59.2 |
| 6,044,983 | A | 4/2000 | Hall | 211/59.2 |
| 6,332,547 | B1 * | 12/2001 | Shaw et al. | 211/59.2 |
| 6,364,136 | B1 | 4/2002 | Weshler et al. | 211/90.02 |
| 6,389,993 | B1 | 5/2002 | Ondrasik | 108/107 |
| 6,490,983 | B1 | 12/2002 | Nicholson et al. | 108/106 |
| 6,497,326 | B1 * | 12/2002 | Osawa | 211/59.2 |
| 6,533,131 | B2 * | 3/2003 | Bada | 211/59.2 |
| 6,561,317 | B1 | 5/2003 | Dudley | 186/38 |
| 6,637,604 | B1 * | 10/2003 | Jay | 211/59.2 |
| 6,715,621 | B2 * | 4/2004 | Boron | 211/59.2 |
| 6,820,754 | B2 | 11/2004 | Ondrasik | 211/59.3 |
| 6,962,260 | B2 * | 11/2005 | Jay et al. | 211/59.2 |
| 7,086,541 | B2 * | 8/2006 | Robertson | 211/59.3 |
| 7,124,898 | B2 * | 10/2006 | Richter et al. | 211/59.3 |
| 7,207,447 | B2 * | 4/2007 | Medcalf et al. | 211/59.2 |
| 2002/0170866 | A1 * | 11/2002 | Johnson et al. | 211/59.3 |
| 2003/0132178 | A1 * | 7/2003 | Jay et al. | 211/59.2 |
| 2004/0020878 | A1 * | 2/2004 | Boron | 211/59.2 |
| 2004/0084389 | A1 * | 5/2004 | Robertson et al. | 211/59.2 |
| 2005/0092703 | A1 * | 5/2005 | Mueller et al. | 211/59.3 |
| 2005/0150847 | A1 * | 7/2005 | Hawkinson | 211/59.2 |
| 2007/0075028 | A1 * | 4/2007 | Nagel et al. | 211/59.2 |
| 2007/0278171 | A1 * | 12/2007 | Jersey et al. | 211/188 |

* cited by examiner

*Primary Examiner*—Jennifer E. Novosad
(74) *Attorney, Agent, or Firm*—DLA Piper LLP US; R. Blake Johnston, Esq.

(57) ABSTRACT

A gravity feed. display rack for supporting and displaying merchandise features a merchandise channel support structure, and at least one merchandise channel. The channel has a merchandise support, a left wall and a right wall, the left wall and right wall adjustably located in spaced apart relationship upon the merchandise channel support structure to accommodate varying sizes of merchandise. Thus the display rack may be adjustably assembled to accommodate specific sizes of merchandise.

7 Claims, 8 Drawing Sheets

BEVERAGE CONTAINER SHELF MANAGEMENT SYSTEM

FIELD OF THE INVENTION

The invention relates, generally, to bottle and can shelving systems and, in particular, to a user configurable shelving system for gravity-feed beverage containers.

BACKGROUND OF THE INVENTION

The prior art includes systems for displaying chilled beverage containers for ready access to retail customers. One system is shown in U.S. Pat. No. 4,785,945, which issued to Rowse, et al., and which is incorporated herein by reference. The prior art further includes U.S. Pat. No. 5,645,176 which issued to Jay, and U.S. Pat. No. 6,389,993 which issued to Ondrasik.

SUMMARY OF THE INVENTION

It is an object of the present invention to provide a shelving system which may be configured by the retail business which displays and sells the containers or beverages.

It is an object of the present invention to provide a bottle or container shelving system which may be reconfigured from the original arrangement.

It is a further object of the present invention to provide a container shelving system which may be configured to accommodate a variety of container sizes, and reconfigured thereafter as desired.

The present inventions therefore provides a gravity feed display rack for supporting and displaying merchandise. The rack having a merchandise channel support structure, and at least one merchandise channel, the channel having a merchandise support, a left wall and a right wall, the left wall and right wall adjustably located in spaced apart relationship upon the merchandise channel support structure to accommodate varying sizes of merchandise.

The present invention further provides a gravity feed display rack for supporting and displaying merchandise. The rack having a merchandise channel support structure, and at least one split merchandise channel, the split channel being adjustable in width, and located upon the merchandise channel support structure.

In another embodiment, the present invention provides a gravity feed display rack for supporting and displaying merchandise. The rack having a merchandise channel support structure, at least one inner divider, the inner divider including a longitudinally extending wall, and a left merchandise support extending from the wall and in a direction generally at a right angle to the wall, and a right merchandise support extending from the wall and in a direction generally at a right angle to the wall, the at least one inner diver having a support structure connector, a left outer divider, the left outer divider including a longitudinally extending wall, and a left merchandise support extending from the wall and in a direction generally at a right angle to the wall, the left outer divider having a support structure connector, and a right outer divider, the right outer divider including a longitudinally extending wall, and a right merchandise support extending from the wall and in a direction generally at a right angle to the wall, the right outer divider having a support structure connector, wherein the dividers are individually adjustably located in spaced apart relationship upon the merchandise channel support structure.

DETAILED DESCRIPTION OF THE INVENTION

Figure 1:
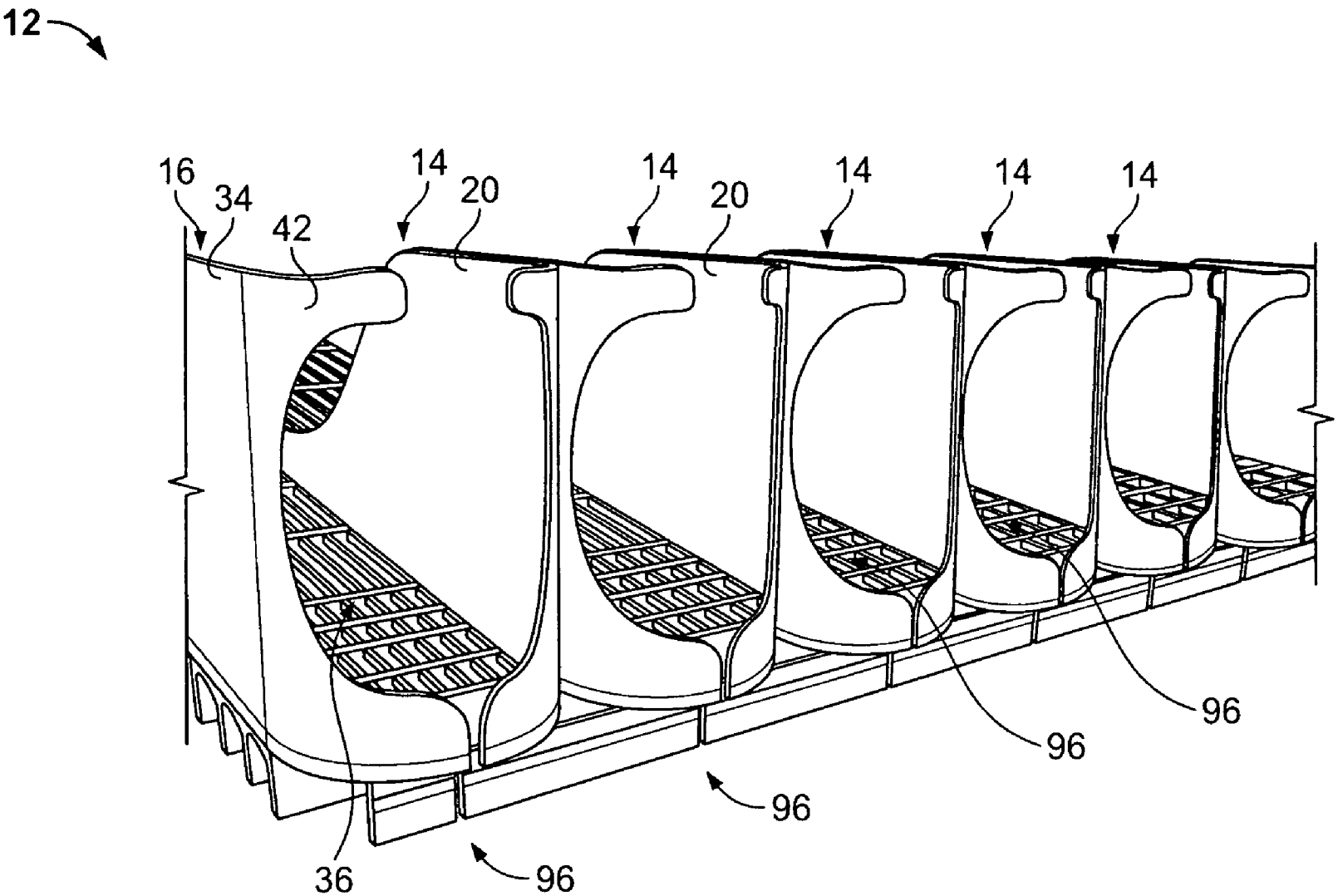
FIG. 1 is a perspective view of the shelf management system in accordance with the present invention.
Figure 2:
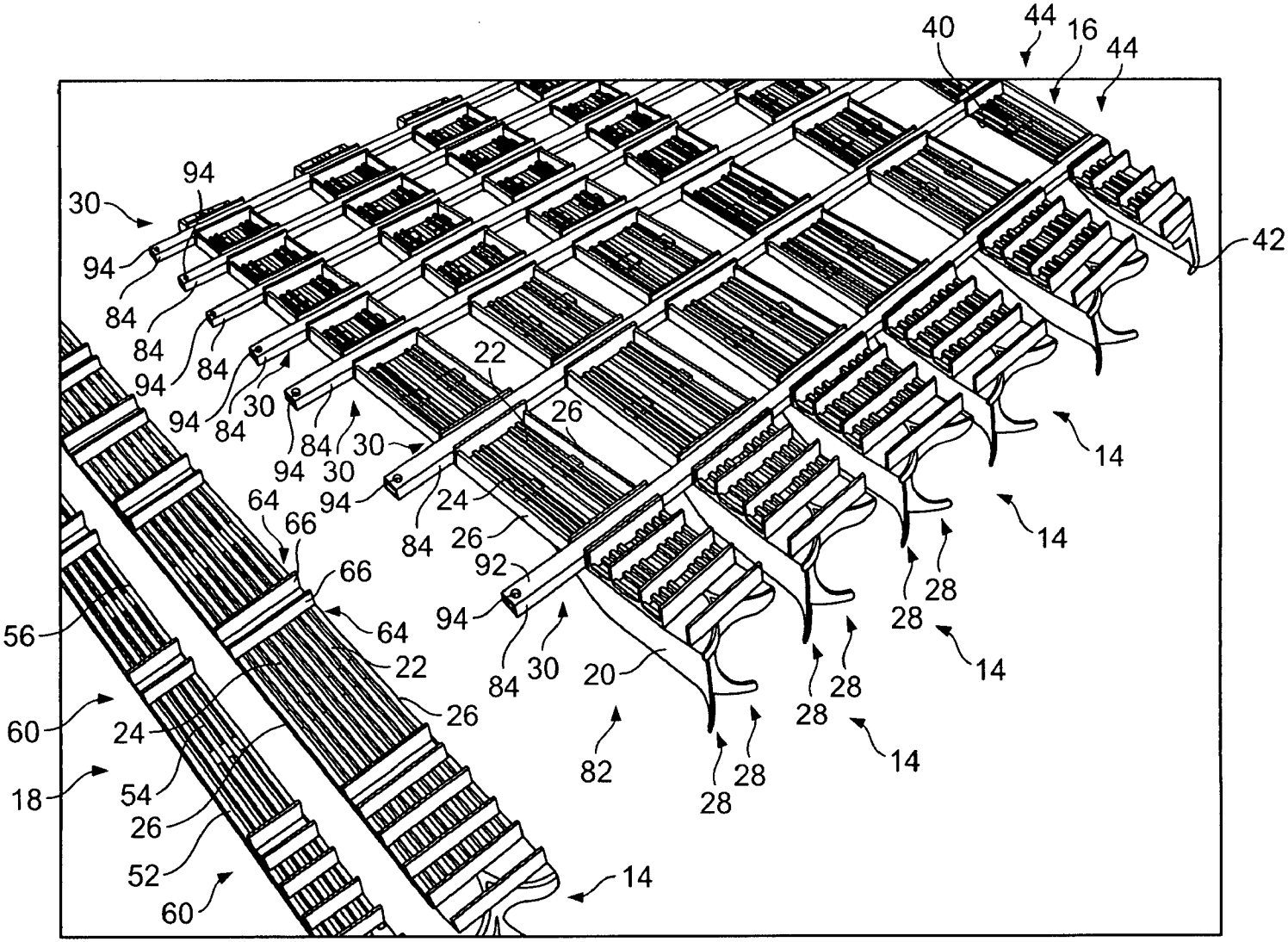
FIG. 2 is a partial exploded bottom perspective view of the shelf management system in accordance with the present invention, showing the left and right channel rails, and a plurality of center rails, and a plurality of rods.

FIG. 1 is a perspective view of the shelf management system in accordance with the present invention. A gravity feed display rack 12 is shown. FIG. 2 is a bottom view of the rack 12, shown partially disassembled. The rack 12 includes a plurality of channel rails or inner dividers 14, a right outer divider 16 and a left outer divider 18 (see FIG. 2). The inner dividers 14 include a longitudinally extending wall 20, with a right and left merchandise support 22, 24 extending in opposite directions from the wall 20. The merchandise supports 22, 24 each having a longitudinally extending edge 26 (see FIG. 2). The wall 20 splits into two diverging curved front walls 28. The inner dividers 14 include a plurality of connectors 30 (see FIG. 2).

The right outer divider 16 includes a longitudinally extending wall 34, with a right merchandise support 36 extending from the wall 34. The merchandise support 36 having a longitudinally extending edge 40. The wall 34 merges into a curved front wall 42. The right divider 32 includes a plurality of connectors 44.

Figure 6A:
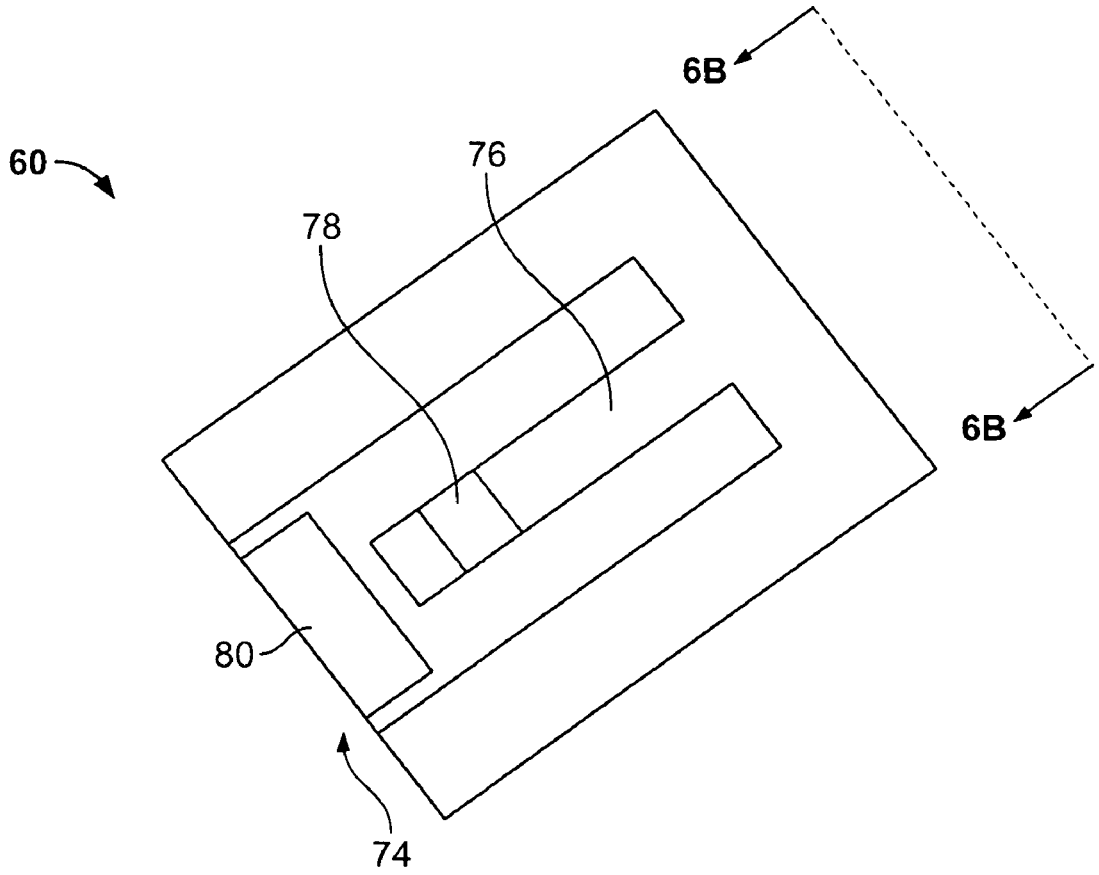
FIGS. 6A and 6B are enlarged views of FIG. 2, showing the connector of the left channel rail.
Figure 6B:
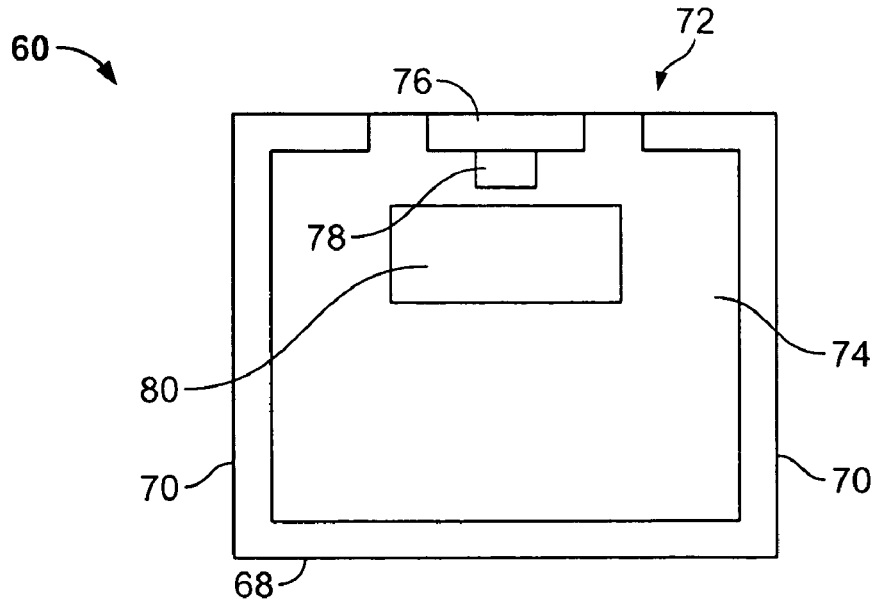
Figure 7:
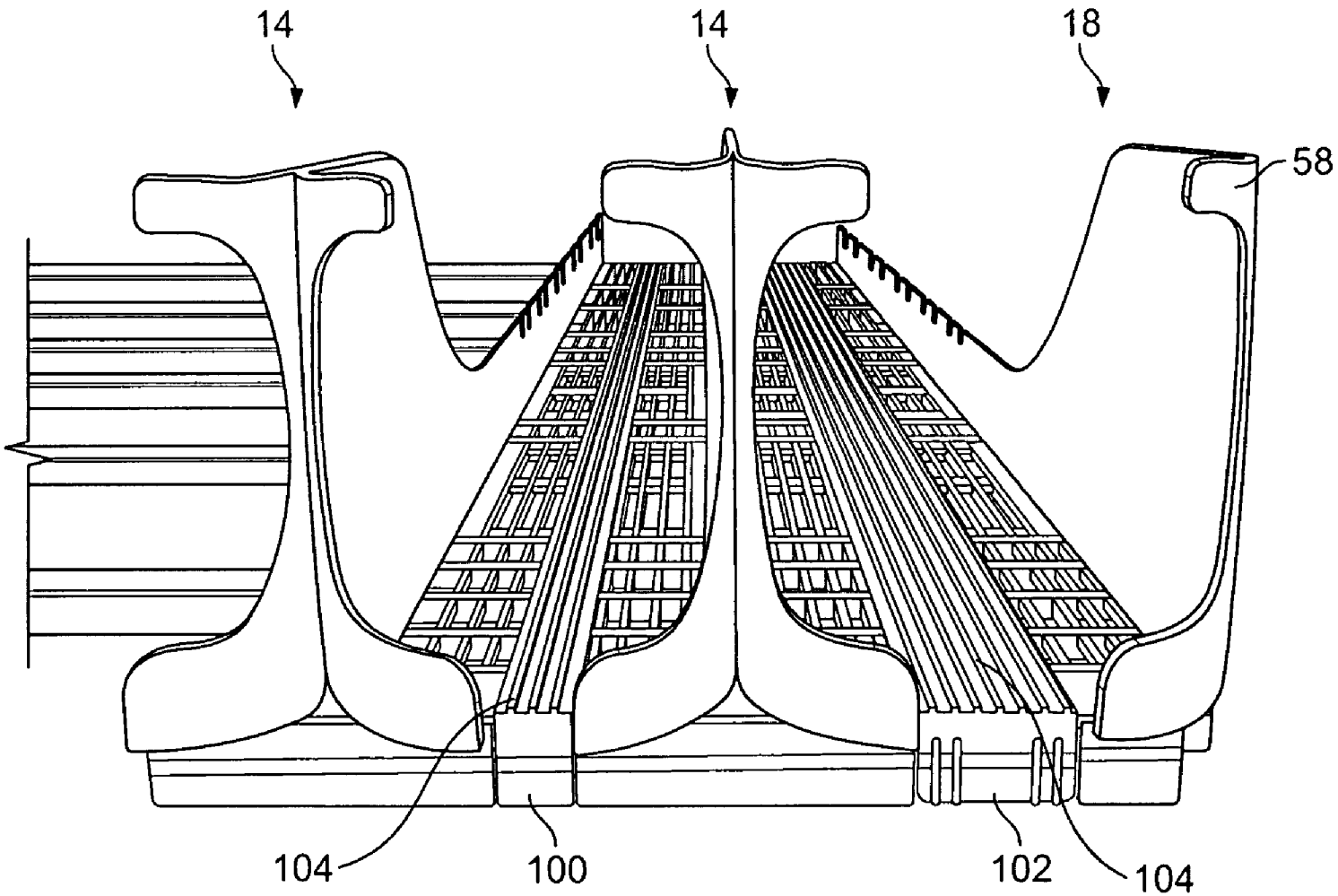
FIG. 7 is a partial front view of the shelf management system in accordance with the present invention, showing a narrow spacer and a wide spacer 4, in accordance with the present invention.

FIG. 2 shows the left outer divider 18. The left divider 18 is a mirror image of the right divider 32. The left divider 18 includes a longitudinally extending wall 52, with a left merchandise support 54 extending from the wall 52. The merchandise support 54 having a longitudinally extending edge 56. The wall 52 merges into a curved front wall 58 (FIG. 7). The left divider 18 includes a plurality of connectors 60 (see FIG. 6) which are similar to connector 44.

Figure 5:
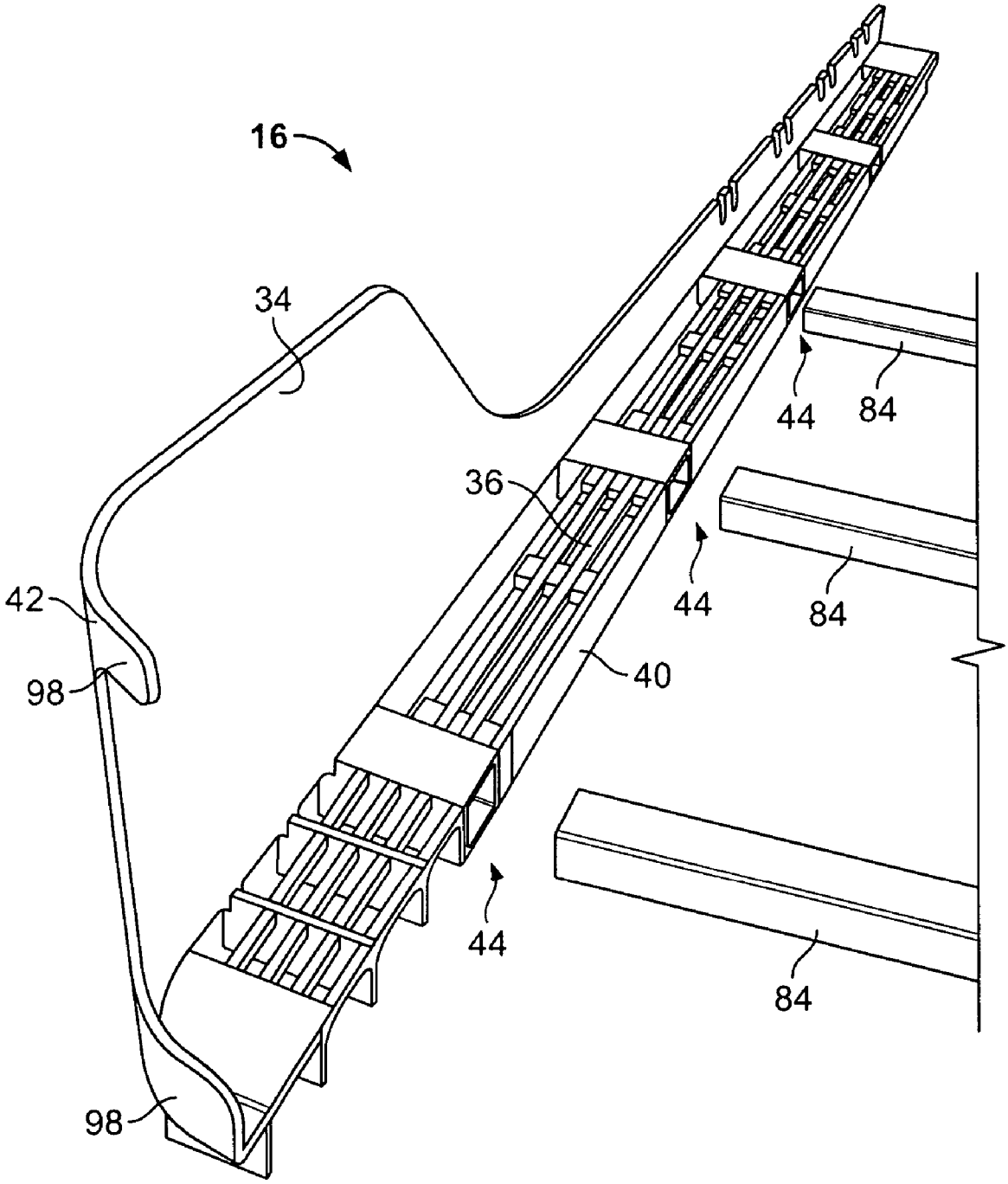
FIG. 5 is a perspective view of a portion of the right side channel rail and a portion of a plurality of rods, in accordance with the present invention.

FIG. 2 shows the connectors, 30, 44 and 60. Each connector 30 is shown to include two depending spaced apart facing connector walls 64 depending downwardly (as viewed from FIG. 1) from the merchandise support. The connector walls each include a flange 66. FIGS. 5 and 6 show that the connectors 44, 60 include a top wall 68, opposing sidewalls 70, a bottom wall 72, and an end wall 74. FIG. 6 shows the bottom wall 72 of connector 60 to include a finger 76, having a locking detent 78. The end wall 74 includes an abutment 80.

FIG. 2 also shows the merchandise channel support structure 82. The merchandise channel support structure 82 includes a plurality of rods 84. The rods 84 include four walls

Figure 4:
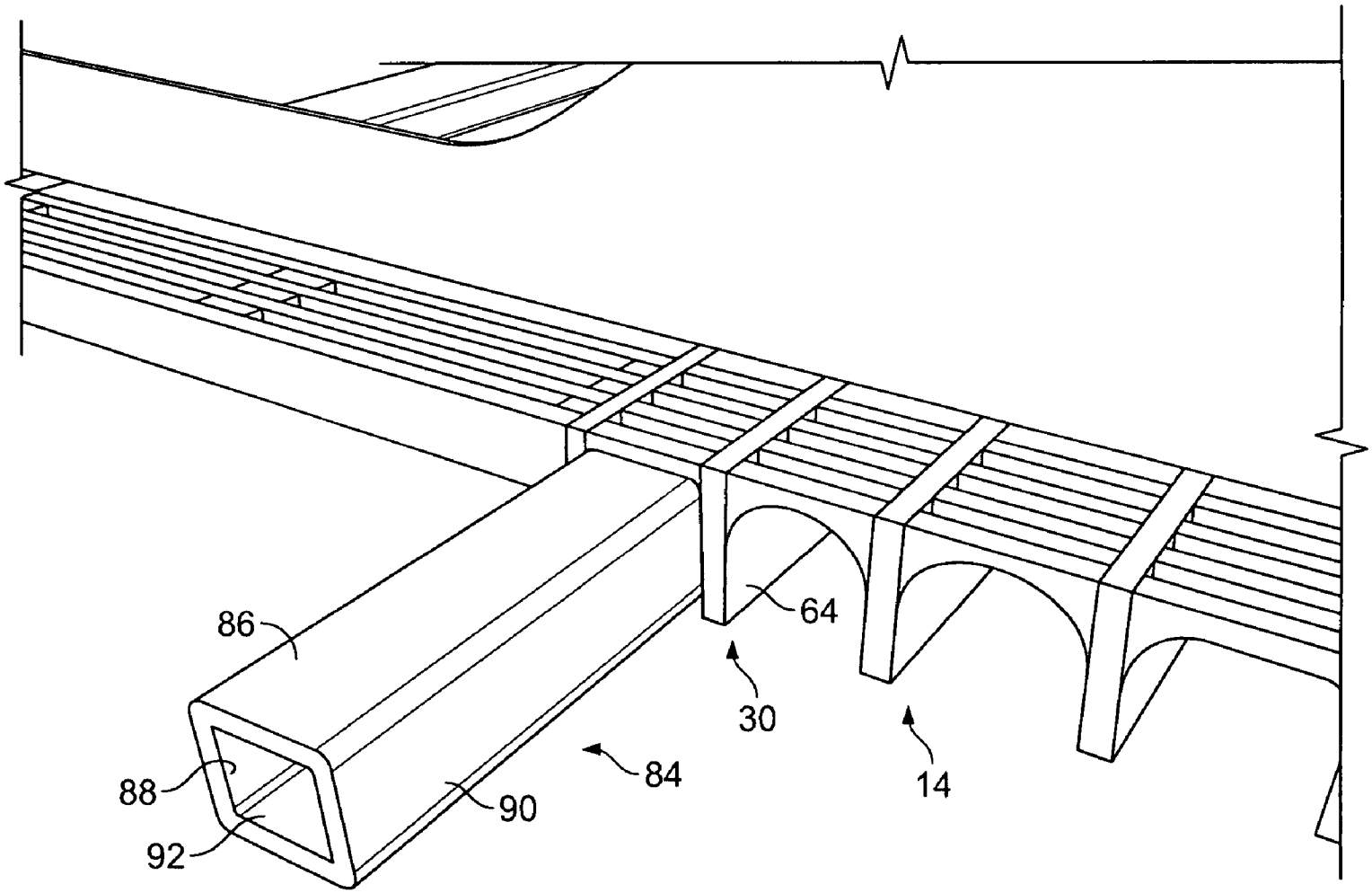
FIG. 4 is an enlarged view of FIG. 3, with a rod extending through the rod passage of the center channel rail.

86, 88, 90 and 92 (see FIG. 4). The bottom wall 92, as viewed in FIG. 1, includes a latch opening 94 (See FIG. 2) at each end of the rod 84.

As demonstrated in FIG. 1, pairs of dividers 14, 16 and 18 form respective split merchandise channels 96.

Figure 3:
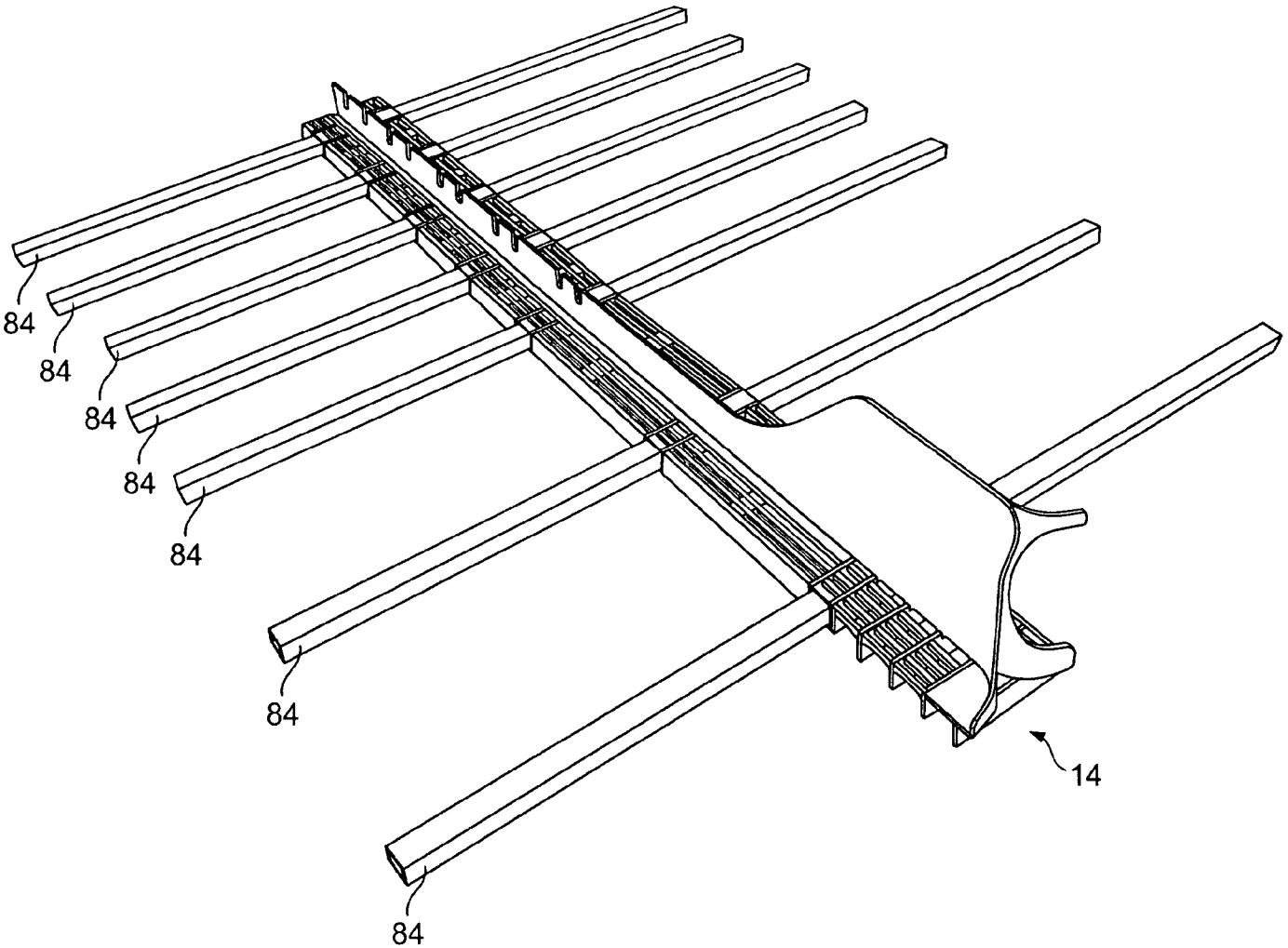
FIG. 3 is a perspective view of a center channel rail and a plurality of rods.

FIGS. 2 and 3 show the plurality of rods 84, each rod shown having an opening 94 to receive a detent 78 of the locking flange 76 for securing the rod in place with respect to the left side channel rail at one side, and the right side channel rail at the other side. The plurality of rods will extend through the respective openings or connectors of the center, left hand and right hand channel rails.

FIG. 4 shows a enlarged view of one inner channel rail 14 with a rod 84 extending through the opening or connector 30. The connector can be seen to be formed by a horizontal surface and two opposed parallel facing vertical surfaces or connector walls 64 having a flange 66 at the end for retaining the rod within the connector 30. The rod extends within the connector 30 but not in an interference fit. Rather, the rod is slidable within the connector 30.

FIG. 5 shows a right side channel rail 16 having a right or longitudinally extending outer wall 34 which extends in a forward direction and curves to provide the curved front wall 42 with lower and upper stops 98. The rail further provides a horizontal surface or merchandise support 36 and a plurality of openings or connectors 44.

Figure 8:
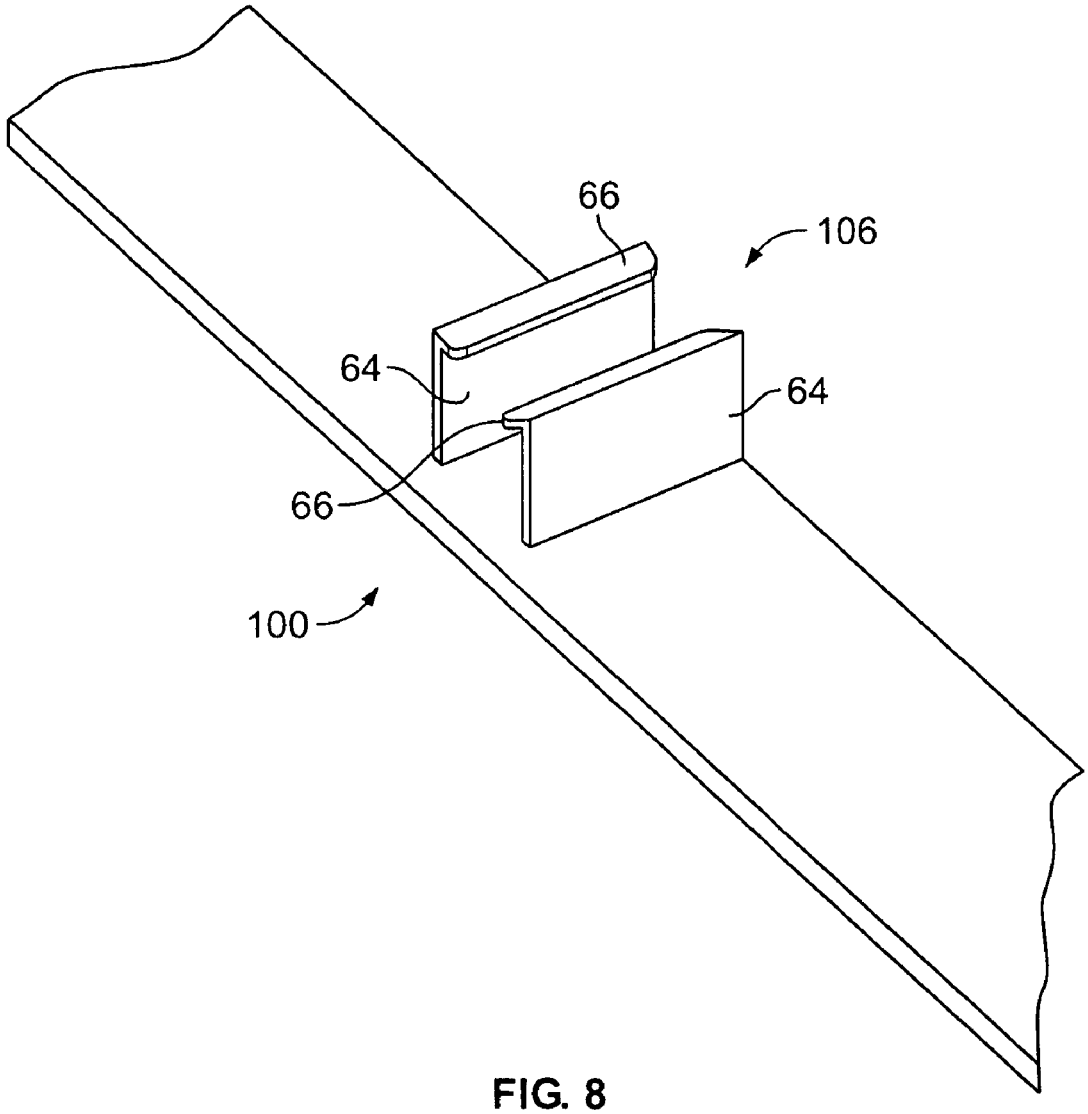
FIG. 8 is a bottom view of a narrow spacer, in accordance with the present invention.

It will be appreciated that when a center channel rail is adjacent to the left hand guide rail, a channel is formed for a certain container size, for example an eight ounce container. The distance between guide rails may be expanded by the use of adaptors or spacers 100, 102 which may be positioned between adjacent guide rails 14, 16, 18. The spacers 100, 102 are shown in FIG. 7 in one embodiment. The spacers include a generally longitudinally extending support surface 104 having a width. The spacers include a plurality of connectors 106 (see FIG. 8) similar to connectors 30. The spacers are positioned between adjacent channel rails 14, 16 and 18 and increase the width between adjacent walls proportional to the width of the spacer. In one embodiment, two sizes of spacers are anticipated, such as the half inch and one inch length spacers 100, 102 shown in FIG. 7.

It will be appreciated that the retail business will be capable of assembling a shelving system using the described component parts, to provide plurality of channels, wherein each channel may be of the same size or of an assortment of sizes, to accommodate various sized merchandise.

The invention claimed is:

1. A gravity feed display rack for supporting and displaying merchandise, comprising:

a merchandise channel support structure including a plurality of spaced rods, each spaced rod oriented in a generally horizontal plane and having a latch opening;

at least one merchandise channel, the channel having a merchandise support, a left wall and a right wall, the left wall and right wall laying in planes oriented perpendicular to the rods of the merchandise channel support structure and located in spaced apart relationship upon the merchandise channel support structure and featuring connectors that slidably receive the rods of the merchandise channel support structure so that the merchandise channel is adjustable to accommodate varying sizes of merchandise without disassembly of the display rack; and locking end connectors that each include a locking detent that is received by the latch openings of the spaced rods.

2. The rack of claim 1, wherein the merchandise support includes a left merchandise support extending from the left wall and in a direction generally towards the right wall, the left merchandise support forming a left longitudinally extending edge, and a right merchandise support extending from the right wall and in a direction generally towards the left wall, the right merchandise support forming a right longitudinally extending edge facing the left longitudinally extending edge.

3. The rack of claim 2, wherein the channel is adapted to be spaced apart to form a particular width, with the facing edges forming a corresponding width, and a spacer having a substantially similar corresponding width and located between the facing edges to form a channel slide upon which the merchandise is gravity feed.

4. The gravity feed display rack of claim 1, wherein each rod has four walls.

5. The gravity feed display rack of claim 1, wherein each rod has a bottom wall that includes the latch opening.

6. The gravity feed display rack of claim 1, wherein the locking end connectors have a bottom wall with a finger that includes the locking detent.

7. The gravity feed display rack of claim 1 wherein the left and right walls each extend in a curved manner to form a front wall, wherein the front walls are adapted to stop downward movement of the displayed merchandise.

* * * * *